US006162129A

United States Patent [19]

Nielsen

[11] Patent Number: 6,162,129

[45] Date of Patent: Dec. 19, 2000

[54] GOLF HANDICAP CALCULATOR

[76] Inventor: Frank M. Nielsen, 1701 Fraser Cir., Corona, Calif. 91720

[21] Appl. No.: 09/258,338

[22] Filed: Feb. 25, 1999

[51] Int. Cl.[7] ..... A63B 57/00

[52] U.S. Cl. ..... 473/131; 473/407; 364/411.1; 273/460

[58] Field of Search ..... 473/131, 407, 473/198; 364/411.1, 410; 273/460; 377/1, 4, 5

[56] References Cited

U.S. PATENT DOCUMENTS

| | | | |
|---|---|---|---|
| 4,142,236 | 2/1979 | Martz et al. | 364/411 |
| 4,286,323 | 8/1981 | Meday | 364/411 |
| 4,367,526 | 1/1983 | McGeary et al. | 364/411 |
| 4,864,592 | 9/1989 | Lee | 377/5 |
| 4,910,677 | 3/1990 | Remedio et al. | 364/410 |
| 5,095,430 | 3/1992 | Bonito et al. | 364/410 |
| 5,536,010 | 7/1996 | Lambourne | 364/411 |
| 5,664,880 | 9/1997 | Johnson et al. | 364/410 |
| 5,683,303 | 11/1997 | Lambourne | 473/131 |
| 5,779,566 | 7/1998 | Wilens | 473/407 |

*Primary Examiner*—Lee Young
*Assistant Examiner*—Minh Trinh

[57] ABSTRACT

A golf handicap calculator is provided including a housing and a display mounted on the housing and adapted to depict numerical characters. Also included is a numeric keypad mounted on the housing for entering numeric data along with a plurality of function keys. Positioned within the housing is a controller that is connected between the display, the keypad, and the function keys. The controller serves to display and store a handicap index upon the depression of one of the function keys with the subsequent entry of a number via the keypad, to display and store a slope upon the depression of one of the function keys with the subsequent entry of a number via the keypad, and to calculate and display a handicap from the handicap index and the slope.

4 Claims, 4 Drawing Sheets

GOLF HANDICAP CALCULATOR

BACKGROUND OF THE INVENTION

1. Field of the Invention

The present invention relates to calculators and more particularly pertains to a new golf handicap calculator for tracking scores of a plurality of rounds of golf and further calculating and tracking a golfer's handicap and index.

2. Description of the Prior Art

The use of calculators is known in the prior art. More specifically, calculators heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,367,526; U.S. Pat. No. 4,266,214; U.S. Pat. No. 3,665,494; U.S. Pat. No. 3,202,803; U.S. Pat. No. 4,910,677; and U.S. Pat. Des. No. 329,451 which are each incorporated herein by reference.

In these respects, the golf handicap calculator according to the present invention substantially departs from the conventional concepts and designs of the prior art, and in so doing provides an apparatus primarily developed for the purpose of tracking scores of a plurality of rounds of golf and further calculating and tracking a golfer's handicap and index.

SUMMARY OF THE INVENTION

In view of the foregoing disadvantages inherent in the known types of calculators now present in the prior art, the present invention provides a new golf handicap calculator construction wherein the same can be utilized for tracking scores of a plurality of rounds of golf and further calculating and tracking a golfer's handicap and index.

The general purpose of the present invention, which will be described subsequently in treater detail, is to provide a new golf handicap calculator apparatus and method which has many of the advantages of the calculators mentioned heretofore and many novel features that result in a new golf handicap calculator which is not anticipated, rendered obvious, suggested, or even implied by any of the prior art calculators, either alone or in any combination thereof.

To attain this, the present invention generally comprises a housing with a substantially rectangular configuration including a front face, a rear face, and a thin periphery formed therebetween. As shown in FIG. 1, a liquid crystal display is mounted on the front face of the housing adjacent to a top edge thereof. In use, the display serves to depict two rows of numerical characters. Also included is a numeric keypad mounted on the front face of the housing in a matrix below toe top display. The numeric keypad includes a plurality of numeric keys each representative of a unique number between 0–9 for entering numeric data. Associated therewith is a plurality of function keys lining a top edge and a side edge of the matrix of the numeric keypad. As shown in FIG. 1, the function keys include a round number key, a score key, a course rating key, a par key, a handicap index key, a slope key, an increase key and a decrease key. An unillustrated controller is positioned within the housing and connected between the display, the keypad, and the function keys. In use, the controller is adapted to display and store a handicap index upon the depression of the handicap index key with the subsequent entry of a number via the keypad. Similarly, the controller is adapted to display and store a slope upon the depression of the slope key with the subsequent entry of a number via the keypad. Once the slope and the handicap index is entered, the controller serves to calculate and display a handicap from the handicap index and the slope. If the handicap index data is not available for entry, the controller is adapted to allow the entry of additional information for calculating the same. Such additional information preferably takes the form of data associated with previous rounds of golf. For entry of such information, the controller is adapted to display a current round and further allow the changing of the current round via the depression of the round key and the subsequent depression of the increase key. The number assigned to the current round data to be entered is then displayed. Thereafter, the controller serves to display and store a score associated with the current round upon the depression of the score key with the subsequent entry of a number via the keypad. Next, the controller displays and stores a par associated with the current round upon the depression of the par key with the subsequent entry of a number via the keypad. Similarly, the controller displays and stores a course rating associated with a golf course upon the depression of the course rating key with the subsequent entry of a number via the keypad. Further, the controller displays and stores a slope associated with a golf course upon the depression of the slope key with the subsequent entry of a number via the keypad. Upon at least the entry of the score, the course rating, and the slope, the controller is adapted to automatically calculate and display a handicap index and difference that is a calculated quantity of adjusted score minus course rating. Thereafter, the handicap index is calculated and the handicap is calculated from the handicap index and the slope and subsequently displayed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf handicap calculator apparatus and method which has many of the advantages of the calculators mentioned heretofore and many novel features that result in a new golf handicap calculator which is not anticipated, rendered obvious, suggested, or even implied by any of the prior art calculators, either alone or in any combination thereof.

It is another object of the present invention to provide a new golf handicap calculator which may be easily and efficiently manufactured and marketed.

It is a further object of the present invention to provide a new golf handicap calculator which is of a durable and reliable construction.

An even further object of the present invention is to provide a new golf handicap calculator which is susceptible of a low cost of manufacture with regard to both materials and labor, and which accordingly is then susceptible of low prices of sale to the consuming public, thereby making such golf handicap calculator economically available to the buying public.

Still yet another object of the present invention is to provide a new golf handicap calculator which provides in the apparatuses and methods of the prior art some of the advantages thereof, while simultaneously overcoming some of the disadvantages normally associated therewith.

Still another object of the present invention is to provide a new golf handicap calculator for tracking scores of a plurality of rounds of golf and further calculating and tracking a golfer's handicap and index.

Even still another object of the present invention is to provide a new golf handicap calculator that includes a housing, and a display mounted on the housing and adapted to depict numerical characters. Also included is a numeric keypad mounted on the housing for entering numeric data along with a plurality of function keys. Positioned within the housing is a controller that is connected between the display, the keypad, and the function keys. The controller serves to display and store a handicap index upon the depression of one of the function keys with the subsequent entry of a number via the keypad, to display and store a slope upon the depression of one of the function keys with the subsequent entry of a number via the keypad, and to calculate and display a handicap from the handicap index and the slope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
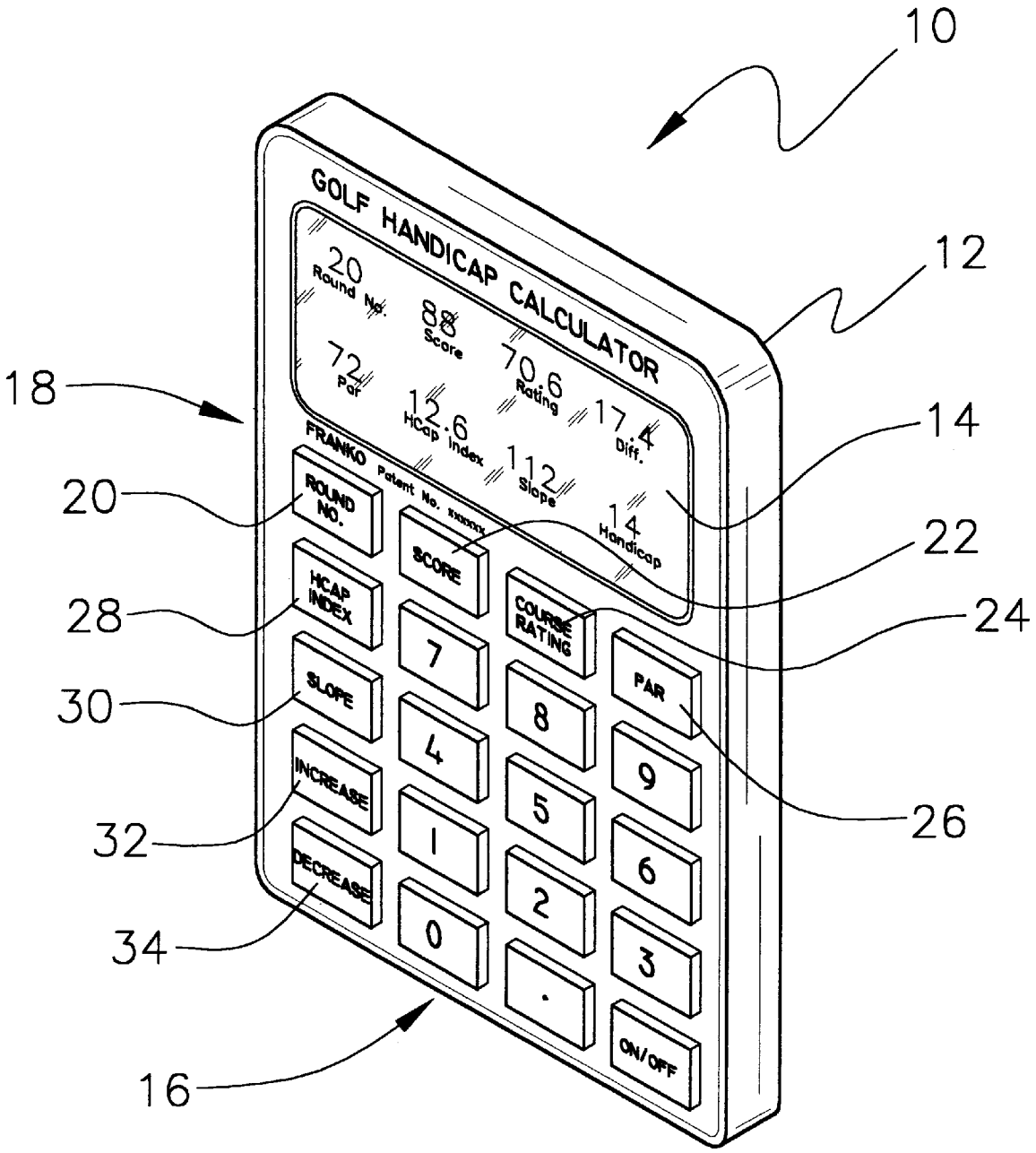
FIG. 1 is a perspective view of a new golf handicap calculator according to the present invention.
Figure 2:
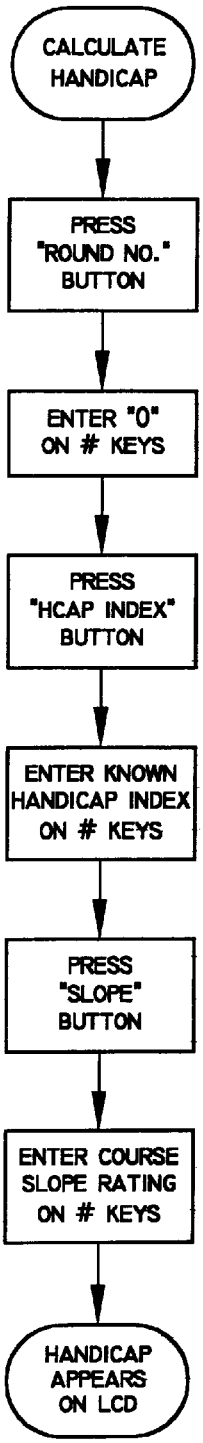
FIG. 2 is a flow chart depicting the manner in which the controller allows the inputting of data and calculation of a handicap when a handicap index is known.

With reference now to the drawings, and in particular to FIGS. 1 through 5 thereof, a new golf handicap calculator embodying the principles and concepts of the present invention and generally designated by the reference numeral 10 will be described.

The present invention, designated as numeral 10, includes a housing 12 with a substantially rectangular configuration including a front face, a rear face, and a thin periphery formed therebetween. As shown in FIG. 1, a liquid crystal display 14 is mounted on the front face of the housing adjacent to a top edge thereof. In use, the display serves to depict two rows of numerical characters. Also included is a numeric keypad 16 mounted on the front face of the housing in a matrix below the top display. The numeric keypad includes a plurality of numeric keys each representative of a unique number between 0–9. for entering numeric data.

Associated therewith is a plurality of function keys 18 lining a top edge and a side edge of the matrix of the numeric keypad. As shown in FIG. 1, the function keys include a round number key 20, a score key 22, a course rating key 24, a par key 26, a handicap index key 28, a slope key 30, an increase key 32 and a decrease key 34.

An unillustrated controller is positioned within the housing and connected between the display, the keypad, and the function keys. In order to accomplish the functions set forth hereinafter, the controller, which may take the form of a microprocessor, is preferably further connected to memory for storage of data and instructions for governing the various operations of the present invention. An ALU may also be provided for carrying out the calculations associated with the present invention.

In use, the controller is adapted to display and store a handicap index upon the depression of the handicap index key with the subsequent entry of a number via the keypad. Similarly, the controller is adapted to display and store a slope upon the depression of the slope key with the subsequent entry of a number via the keypad. It should be understood that the slope rating is a difficulty rating of a golf course. Once the slope and the handicap index is entered, the controller serves to calculate and display a handicap from the handicap index and the slope.

If the handicap index is not available for entry, the controller is adapted to allow the entry of additional information for calculating the same. Such additional information preferably takes the form of data associated with previous rounds of golf. For entry of such information, the controller is adapted to display a current round and further allow the changing of the current round via the depression of the round key and/or the subsequent depression of the decrease and increase keys. When the round is selected, the number assigned to the current round data to be entered is then displayed. It should be noted that at start up of the present invention, the round indicated is always "0" after which the user may select a current round. To enter data relating to a new round, a new number must be selected which is preferably 1 unit greater than a current highest round.

Figure 3:
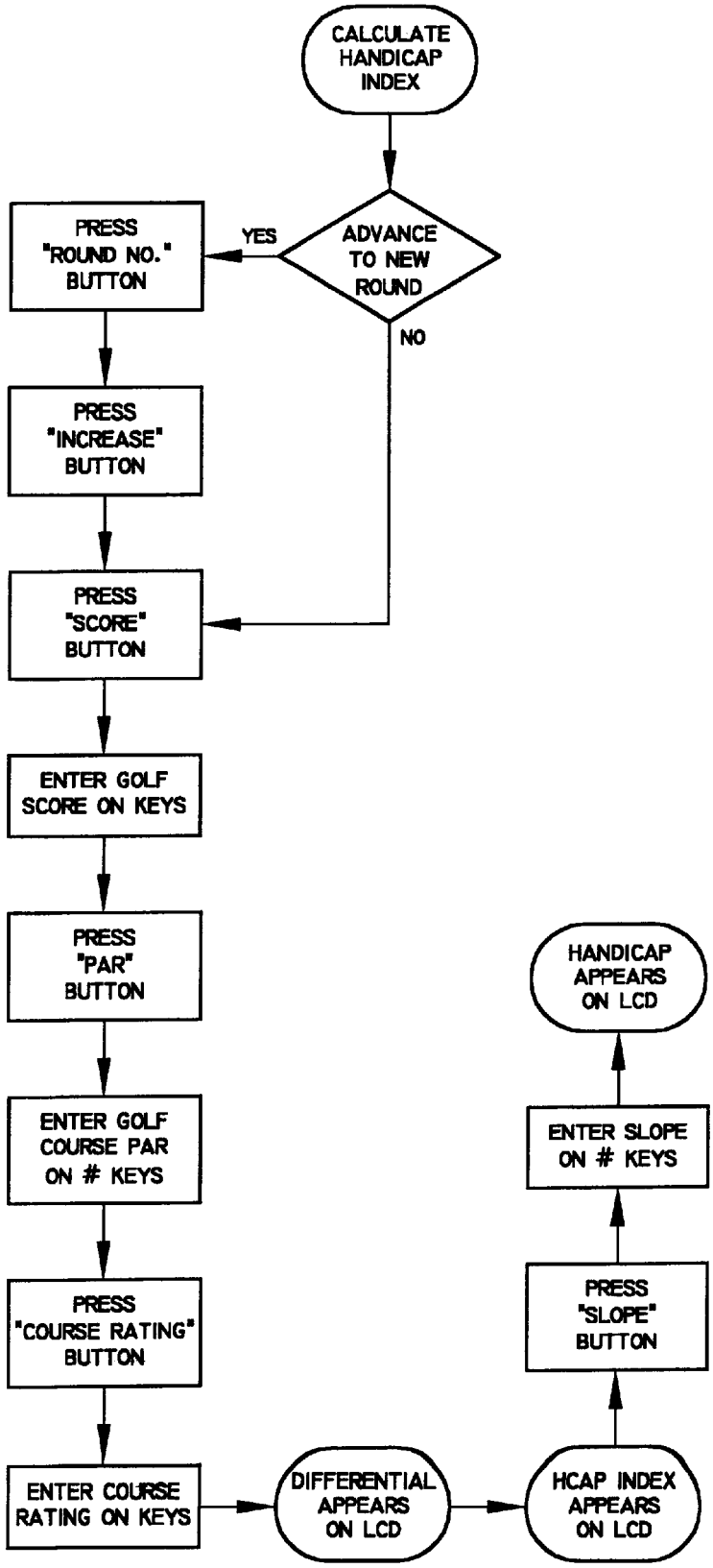
FIG. 3 is a flow chart depicting the manner in which the controller allows the inputting of data and calculation of a handicap when a handicap index is not known.

As shown in FIG. 3, the controller serves to display and store a score of a user associated with the current round upon the depression of the score key with the subsequent entry of a number via the keypad. Next, the controller displays and stores a par associated with the current round upon the depression of the par key with the subsequent entry of a number via the keypad. Similarly, the controller displays and stores a course rating associated with a golf course upon the depression of the course rating key with the subsequent entry of a number via the keypad. It should be understood that the course rating is a typical score of a professional golfer at a golf course. Further, the controller displays and stores a slope associated with a golf course upon the depression of the slope key with the subsequent entry of a number via the keypad. Upon at least the entry of the score, the course rating, and the slope, the controller is adapted to automatically calculate and display a handicap index and difference that is a calculated quantity of adjusted gross score minus course rating. Thereafter, the handicap index is calculated and the handicap is calculated from the handicap index and the slope and subsequently displayed.

As shown in FIG. 1, the display has two rows of identification indicia for indicating the nature of the number situated thereabove. Such indicia includes "round number", "score", "rating" and "difference" on the top row and "par", "handicap index", "slope" and "handicap" on the bottom row. Ideally, the numbers are configured exactly as shown in FIG. 1 for facilitating entry and convenient browsing, that will soon be set forth. When entering data in the manner set forth hereinabove, the number above the identification indicia is adapted to blink intermittently upon the associated function being depressed. Such blinking number continues until the number is entered and/or the depression of an unillustrated "enter" button.

Figure 4A:
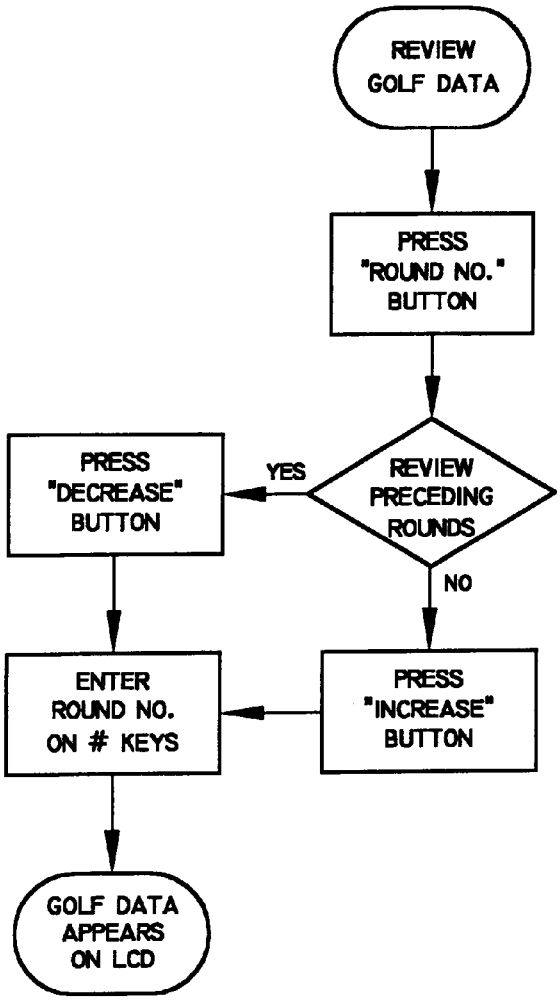
FIG. 4*a* is a flow chart delineating the manner in which the controller of the present invention allows the browsing of the collected and calculated round data via the numeric keypad and the increase and decrease keys.
Figure 4B:
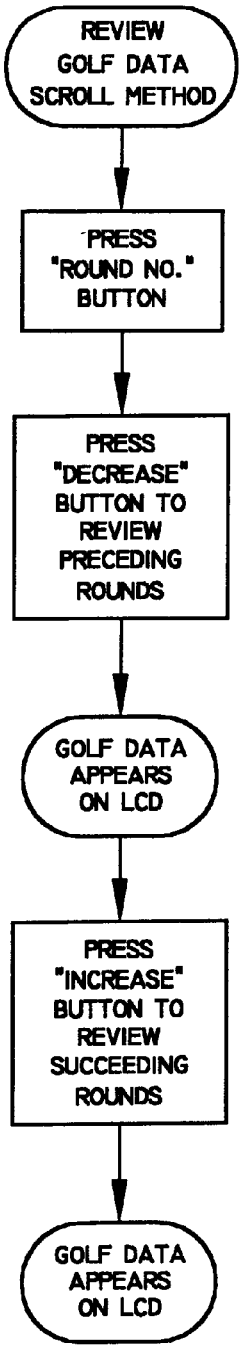
FIG. 4*b* is a flow chart delineating the manner in which the controller of the present invention allows the browsing of the collected and calculated round data via merely the increase and decrease keys.
Figure 4C:
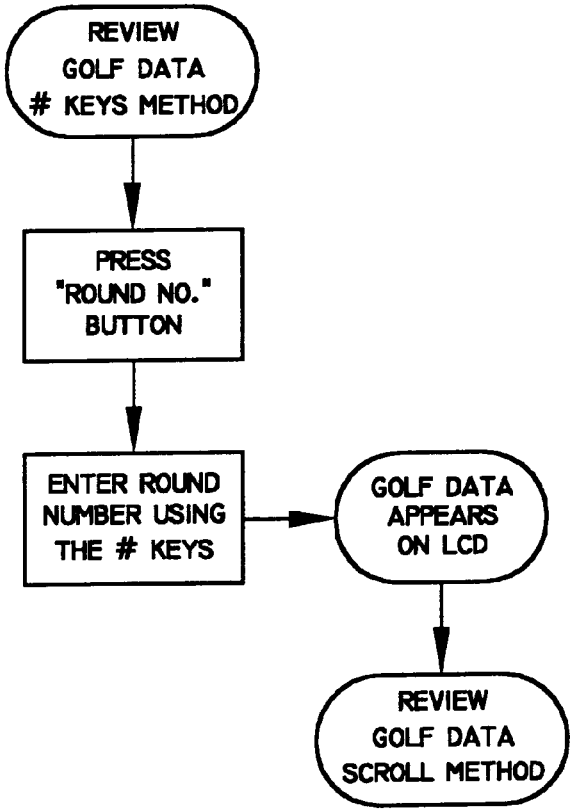
FIG. 4*c* is a flow chart delineating the manner in which the controller of the present invention allows the browsing of the collected and calculated round data via merely the numeric keypad.
Figure 5:
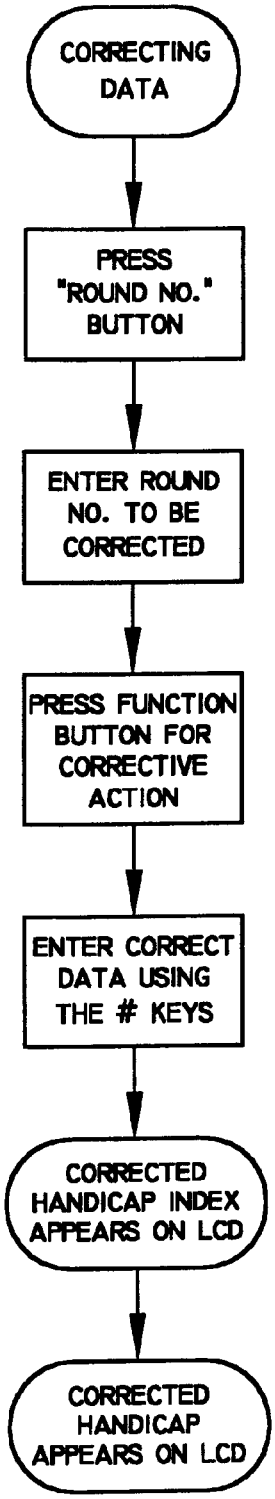
FIG. 5 is a flow chart of the method by which the controller allows the round data to be edited.

It should be noted that controller further allows the browsing of past round data by displaying round number, and the score, the course rating, the difference, the par, the handicap index, the slope and the handicap index associated therewith. It should be noted that the current round which is to be viewed may be selected via the keypad after the depression of the round key, via the increase and the decrease key, or via a combination thereof, as shown in FIGS. 4*a*, 4*b*, & 4*c*. When browsing, various data may be edited in the manner set forth hereinabove after which the controller is adapted to automatically recalculate the handicap index of all subsequent rounds and the current handicap.

Additional information regarding the background use of the present invention will now be set forth. The present invention is an electronic golf calculator adapted to automatically calculate a golfer's handicap index and translate this number into a handicap for a given course. More generally, the same device can provide the correct handicap for any given golf handicap index for any golf course.

The calculation of a golfer's handicap is a function of the handicap index of the player and the slope rating (difficulty) of the golf course, the player must first calculate his or her own handicap index. The first step in calculating handicap index is to determine the converted differential for each round (18 holes) of play. The converted differential is determined by subtracting the golfer's adjusted gross score from the course rating. For example, suppose a golfer shoots an 88 (adjusted gross score) on a course with a rating of 70.6. The differential is determined as follows:

| | |
|---|---|
| Adjusted Gross Score | 88.0 |
| Golf Course Rating | − 70.6 |
| Actual Differential | 17.4 |

The second step in calculating handicap requires that the actual differential be "converted" into the converted differential, which involves using the golf course slope rating. Each set of tees on each golf course has a difficulty rating ranging from 67 (easiest) to 155 (most difficult). The actual differential is "converted" by multiplying by a fixed value multiplier, 113, and then dividing by the slope of the set of tees being played.

In this example, suppose the player is golfing on a course with a slope rating of 125. The converted differential would be calculated as follows:

| | |
|---|---|
| Actual Differential | 17.4 |
| Multiplier | × 113.0 |
| Multiplier Product | 1966.2 |
| Divided by Slope of Tees Played | 125.0 |
| Converted Differential | 15.7 |

Note that the multiplier, 113, is fixed and does not change with the golf course nor the golfer. Also note that differentials are rounded to the nearest tenth.

The golf handicap index is based on the lowest 10 of these differentials (representing the best 10 rounds played) from the most recent 20 rounds played. The golf handicap index is calculated by adding up the lowest 10 converted differentials and multiplying by 0.96, and dividing the total by 10.

As each round is played, there is a new "previous 20 rounds"from which to recalculate the handicap index. Hence, the golfer's index can always rise or fall. The present invention affords an easy way to automatically recalculate and update the handicap index after each round of play.

If a golfer is just beginning to calculate his or her handicap index, but has fewer than 20 rounds, but has at least five rounds golfed, the handicap index is computed differently. Rather than basing the handicap index on the lowest 10 of the previous 20 rounds played the following scores are used:

| Rounds Played | Scores to be Used |
|---|---|
| 19 | Lowest 9 |
| 18 | Lowest 8 |
| 17 | Lowest 7 |
| 15 or 16 | Lowest 6 |
| 13 or 14 | Lowest 5 |
| 11 or 12 | Lowest 4 |
| 9 or 10 | Lowest 3 |
| 7 or 8 | Lowest 2 |
| 5 or 6 | Lowest 1 |

For example, if a golfer had played 10 rounds of golf with the lowest three converted differentials being 22.2, 20.6, and 18.0, the player's handicap index would be calculated as follows:

| Total of three Converted Differentials: | |
|---|---|
| 22.2 + 20.6 + 18.0 | = 60.8 |
| Divided by Number of Scores | 3.0 |
| Player's Handicap Index | 20.2 |

Note that the player's handicap index actually calculates out to be 20.27, but the number is rounded down to the nearest tenth when computing handicap index for players with fewer than 20 rounds played.

Note that in the above golf handicap index calculations the golfers are required to input their adjusted gross score rather than simply use their score for the round. Adjusted gross score is the golfer's score based on local regulations in which the player is limited in the scoring of each hole played so as not to create overly high scores on single or multiple holes which would unfairly inflate the golfer's handicap index. The scoring(i.e., how many strokes over par a golfer is allowed to score on a hole is limited by the golfer's handicap index.

For example, the golfer may not be able to take a score of higher than 8 for a par five hole. If he or she were to duff a few shots on a par five hole and wind up with a score for the hole of 10, then a score of "8" would be entered for the purpose of adding up the adjusted gross score. The rule applies to the entire round played, and thus a player's adjusted gross score might not necessarily be identical with his or her actual score.

A player's golf handicap for a given course depends on his or her handicap index and the golf course's slope rating (difficulty). Once the player has established a handicap index, the player's handicap is obtained form a handicap verses slope rating table. (These tables are very large.) This information is conveniently tabulated by the present invention. Generally, the handicap decreases for easy course and increases for difficult courses. Handicap will be calculated using the formula: (Handicap Index×Slope)÷113=Handicap. The calculation is rounded to the nearest whole number.

For example, a golfer with a handicap rating of 12.6 will have a handicap of 10 playing at an open, easy golf course, where the slope rating is 90. However, the same golfer would have a handicap of 13 at a fairly difficult municipal course, with a slope rating of 115. If this player went to Pebble Beach, where the slope rating is 144, his or her handicap would be 16. The present invention would indicate the golfer's proper handicap for any course in the world. It would also provide the handicap for any other golfer's handicap index.

With the present invention, the golfer could also scroll through previous rounds played to view past scores and to discern trends in his or her handicap index. This handy device would keep track of the last 999 rounds played, so there would be plenty of time for the golfer to keep track of the proficiency trend.

Access to this sort of information is currently only available in printed form. The present invention would be a small device, similar to a calculator, with an LCD display on the top of the front face and keys underneath. Keys 0 through 9, a decimal point, and ON/OFF would cover a 3 by 4 array in the lower right-hand corner.

On the top row and left column of the keypad would be the following function keys, each key followed by a description of its function. ROUND NO.—when the person starts inputting golf scores, he is in Round No. 1 and counting. One could use this key to go to a previous round for review or to go to the next number to begin to input the latest score. SCORE—score, which is actually the adjusted gross score, is for the round just played. The person's new handicap index would be calculated according to his or her score. COURSE RATING—golf course rating is the theoretical typical score of a professional golfer at the course. It is used in the handicap index calculation and is obtained from the scorecard. PAR—inputs par for the course played. This is for the golfer's reference, but it does not affect the calculations. HCAP INDEX—handicap index is calculated and displayed. In combination with the slope rating, the handicap is calculated. SLOPE—slope rating is the golf course's difficulty rating and is used in calculating the handicap. It is obtained form the scorecard. INCREASE and DECREASE—these keys scroll the display to the next higher or lower (chronological) round of golf played.

The present invention affords convenience, accuracy, portability, versatility, ease of use, and economy for golfers. The calculation of golf handicaps is a complex process combining two different variables: the skill of the golfer and the difficulty of the course. Each golfer's skill level is represented in this equation by his or her handicap index. The calculation of the handicap index involves consideration of the scores of 20 different golf games. In addition, each golfer's handicap index can potentially change every time he or she plays a game.

Each course's difficulty is represented by the slope rating. The slope rating and handicap index are combined to give a golfer's handicap on a given day on a given course, and a given set of tees played. While golfing, golfers cannot carry around the tables, calculators, pencils, and paper that they would need to calculate their changing handicaps as they change golf course or as their performance fluctuates. Yet, such information would be useful. The current handicap of the golfer would be easy to calculate using the present invention.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf handicap calculator comprising, in combination:

a housing with a substantially rectangular configuration including a front face, a rear face, and a thin periphery formed therebetween;

a liquid crystal display mounted on the front face of the housing adjacent to a top edge thereof, the display adapted to depict two rows of numerical characters;

a numeric keypad mounted on the front face of the housing in a matrix below the top display and including a plurality of numeric keys each representative of a unique number between 0–9 for entering numeric data;

a plurality of function keys lining a top edge and a side edge of the matrix of the numeric keypad, the function keys including a round number key, a score key, a course rating key, a par key, a handicap index key, a slope key, an increase key and a decrease key;

a controller positioned within the housing and connected between the display, the keypad, and the function keys, the controller being adapted to store information regarding a plurality of rounds of golf; and said controller being adapted to display and store a handicap index upon the depression of the handicap index key with the subsequent entry of a number using the keypad, to display and store a slope upon the depression of the slope key with the subsequent entry of a number using the keypad, and to calculate and display a handicap from the handicap index and the slope;

said controller being adapted to display information regarding one of the plurality of rounds including a current round, the controller being adapted to allow the changing of the round having information displayed on the display by the depression of the increase key and the decrease key, to display and store a score associated with the current round upon the depression of the score key with the subsequent entry of a number using the keypad, to display and store a par associated with the current round upon the depression of the par key with the subsequent entry of a number using the keypad, to display and store a course rating associated with a golf course upon the depression of the course rating key with the subsequent entry of a number using the keypad, to display and store a slope associated with a golf course upon the depression of the slope key with the subsequent entry of a number using the keypad, to calculate and display a handicap index and a difference upon the entry of the score, the slope, and the course rating, and to calculate and display a handicap from the handicap index and the slope, said controller being adapted to calculate the handicap index upon the information regarding the plurality of rounds;

said controller being adapted to display the score, the course rating, the difference, the par, the handicap index, the slope and the handicap index associated with a round entered using the keypad after the depression of the round key;

said controller being adapted to display the score, the course rating, the difference, the par, the handicap index, the slope and the handicap associated with a round chosen using the increase key and the decrease key after the depression of the round key.

2. A golf handicap calculator comprising:

a housing;

a display mounted on the housing adapted to depict numerical characters;

a numeric keypad mounted on the housing for entering numeric data;

a plurality of function keys;

a controller positioned within the housing and connected between the display, the keypad, and the function keys; and said controller being adapted to display information regarding one of the plurality of rounds including a current round, the controller being adapted to allow the changing of the round having information displayed on the display by the depression of an increase key and a decrease key;

said controller being adapted to display and store a handicap index upon the depression of at least one of the function keys with the subsequent entry of a number using the keypad, to display and store a slope upon the depression of one of the function keys with the subsequent entry of a number using the keypad, and to calculate and display a handicap from the handicap index and the slope;

wherein the function keys includes a round number key, a score key, a course rating key, a par key, and a handicap index key, a slope key.

3. A golf handicap calculator as set forth in claim 2 wherein the controller is adapted to display and store a score associated with the current round upon the depression of one of the function keys with the subsequent entry of a number using the keypad, to display and store a par associated with the current round upon the depression of one of the function keys with the subsequent entry of a number using the keypad, to display and store a course rating associated with a golf course upon the depression of one of the function keys with the subsequent entry of a number using the keypad, to display and store a slope associated with a golf course upon the depression of one of the function keys with the subsequent entry of a number using the keypad, to calculate and display a handicap index upon the entry of the score, the slope, and the course rating, said controller being adapted to calculate the handicap index upon the information regarding the plurality of rounds.

4. A golf handicap calculator as set forth in claim 2 wherein said controller is adapted to display the score, the course rating, the difference, the par, the handicap index, the slope and the handicap index associated with a round entered using the keypad after the depression of a round key.

* * * * *